US007716891B2

(12) United States Patent
Radford

(10) Patent No.: US 7,716,891 B2
(45) Date of Patent: May 18, 2010

(54) ATTACHMENT SYSTEM FOR PANEL OR FACADE

(75) Inventor: Jerry L. Radford, Dallas, GA (US)

(73) Assignee: Altech Panel Systems, LLC, Cartersville, GA (US)

( * ) Notice: Subject to any disclaimer, the term of this patent is extended or adjusted under 35 U.S.C. 154(b) by 1147 days.

(21) Appl. No.: 11/177,770

(22) Filed: Jul. 8, 2005

(65) Prior Publication Data

US 2009/0145071 A1 Jun. 11, 2009

(51) Int. Cl.

| | |
|---|---|
| ***E04B 2/00*** | (2006.01) |
| ***E04B 5/00*** | (2006.01) |
| ***E04B 9/00*** | (2006.01) |
| ***E04H 1/00*** | (2006.01) |

(52) U.S. Cl. ..... 52/506.08; 52/235; 52/506.05; 52/506.06; 52/506.07; 52/474

(58) Field of Classification Search ..... 52/235, 52/506.05, 506.06, 506.07, 506.08, 506.09, 52/474, 475, 476

See application file for complete search history.

(56) References Cited

U.S. PATENT DOCUMENTS

| | | | | |
|---|---|---|---|---|
| 4,021,987 | A * | 5/1977 | Schnebel et al. | 52/764 |
| 4,307,551 | A * | 12/1981 | Crandell | 52/235 |
| 4,483,122 | A * | 11/1984 | Crandell | 52/747.1 |
| 4,506,484 | A * | 3/1985 | Bartlett et al. | 52/476 |
| 4,622,794 | A * | 11/1986 | Geortner | 52/396.05 |
| 4,625,481 | A * | 12/1986 | Crandell | 52/235 |
| 4,768,321 | A * | 9/1988 | Crandell | 52/235 |
| 4,866,896 | A * | 9/1989 | Shreiner et al. | 52/235 |
| 5,265,396 | A | 11/1993 | Amimoto | |
| 5,829,216 | A | 11/1998 | Newcomb et al. | |
| 6,035,598 | A | 3/2000 | Sukolics et al. | |
| 6,098,364 | A | 8/2000 | Liu | |
| 6,330,772 | B1 | 12/2001 | Mitchell et al. | |
| 6,484,465 | B2 * | 11/2002 | Higgins | 52/474 |
| 6,748,709 | B1 | 6/2004 | Sherman et al. | |
| 2002/0124514 | A1 * | 9/2002 | Higgins | 52/506.06 |

* cited by examiner

*Primary Examiner*—Richard E Chilcot, Jr.
*Assistant Examiner*—Andrew J Triggs
(74) *Attorney, Agent, or Firm*—Charles L. Warner, II; Bryan Cave LLP

(57) ABSTRACT

Panels (20A, 20B) are attached to extrusions (66A, 66B) by fasteners 90. Clips (70) are attached to a structure (50) by fasteners (35). The extrusions and the clips engage in a manner which allows the panels to move in any direction, as needed, without the panel detaching from the structure and falling. The extrusions also provide for the use of optional reveal strips (87). An extrusion has a restraining area (86), a reveal strip stop area (58), and a T-slot (65). A clip has a T-channel (74), a tensioning stop arm (69), and a secondary reinforcing arm (80). The panels can be installed in rows, in columns, or diagonally, as desired.

25 Claims, 4 Drawing Sheets

ATTACHMENT SYSTEM FOR PANEL OR FACADE

BACKGROUND OF THE INVENTION (1) Field of the Invention

The present invention relates generally attachment systems for wall panels or facades and, more particularly, to an attachment system which provides for four-way movement of the panel or facade.

(2) Description of the Related Art

Existing attachment systems do not provide for four-way movement of the panels, require extensive on-site preparation or modification, and can disengage from the panel, allowing the panel to fall out, if the panel moves beyond a very limited amount, is improperly installed, or contracts beyond a very limited amount.

BRIEF SUMMARY OF THE INVENTION

One embodiment of the present invention provides an apparatus for securing a first panel and a second panel to a structure, each panel having a main portion, a lip, and a hole in the lip. The apparatus includes a clip and first and second extrusions. The clip includes a clip base having a first area and a second area, a generally "T"-shaped track extending from the first area, and a generally "L"-shaped stop. The "L"-shaped stop has a first base extending from the second area at approximately 90 degrees and an arm extending from the distal end of the first base at approximately 90 degrees, the arm generally extending parallel to the clip base and away from the first area. The clip base has a hole between the "T"-shaped track and the "L"-shaped stop and adapted to accommodate a fastener to secure the clip to the structure.

An extrusion includes a generally "U"-shaped base, a first leg, and first and second generally "L"-shaped extensions. The "U"-shaped base has a first arm and a second arm, and the second arm has an end and a base. The "U"-shaped base is adapted to receive an "L"-shaped stop of the clip. The first leg extends at approximately 90 degrees from the first arm of the "U"-shaped base and has a hole therein to accommodate a fastener to secure the extrusion to a panel. The first extrusion is secured to the first panel and the second extrusion is secured to the second panel. A generally "L"-shaped extension extends at approximately 90 degrees from the second arm of the "U"-shaped base, the first extension extends from the end of the second arm, the second extension extends from the base of the second arm. The second arm, the first extension and the second extension form a generally "T"-shaped opening adapted to receive the "T"-shaped track. The "U"-shaped base of one extrusion receives the "L"-shaped stop and the "T"-shaped opening of the other extrusion receives the "T"-shaped track.

In another embodiment, the clip further comprises a generally "L"-shaped extension having a base and an arm and extending from the clip base, the "T"-shaped track being between the "L"-shaped extension and the hole, the base of the "L"-shaped extension extending at approximately 90 degrees from the clip base, the arm extending at approximately 90 degrees from the distal end of the base of the "L"-shaped extension, and the arm generally extending parallel to the clip base and toward the second area.

In another embodiment, at least one extrusion further comprises a third arm extending at approximately 90 degrees from the base of the "U"-shaped base and forming a first receptacle area with respect to the first arm of the "U"-shaped base and a second receptacle area with respect to the second arm of the "U"-shaped base, the first receptacle adapted to receive a reveal strip, the second receptacle adapted to receive the "L"-shaped stop of the clip.

In another embodiment, the third arm has a knob on the end.

In another embodiment, the "L"-shaped stop has a knob on the distal end.

Yet another embodiment of the present invention provides an apparatus to secure a panel having an extrusion to a structure. The apparatus includes a clip base, a generally "T"-shaped track, and a generally "L"-shaped stop. The clip base has a first area and a second area. The generally "T"-shaped track extends from the first area and is adapted to engage the extrusion. The generally "L"-shaped stop is adapted to engage the extrusion, and has a first base extending from the second area at approximately 90 degrees and an arm extending from the distal end of the first base at approximately 90 degrees. The arm generally extends parallel to the clip base and away from the first area. The clip base has a hole between the "T"-shaped track and the "L"-shaped stop and is adapted to accommodate a fastener to secure the clip to a structure.

In another embodiment, the apparatus also has a generally "L"-shaped extension having a base and an arm and extending from the clip base, where the "T"-shaped track being between the "L"-shaped extension and the hole. The base of the "L"-shaped extension extends at approximately 90 degrees from the clip base, the arm extends at approximately 90 degrees from the distal end of the base of the "L"-shaped extension, the arm generally extends parallel to the clip base and toward the second area.

In another embodiment the "L"-shaped stop has a knob on the distal end.

In still another embodiment the apparatus has a generally "U"-shaped base, a first leg, and first and second generally "L"-shaped extensions. The generally "U"-shaped base has a first arm and a second arm, the second arm has an end and a base, and the "U"-shaped base is adapted to engage a clip. In another embodiment the first leg extends at approximately 90 degrees from the first arm of the "U"-shaped base and has a hole therein to accommodate a fastener to secure the apparatus to the panel. A generally "L"-shaped extensions extends at approximately 90 degrees from the second arm of the "U"-shaped base, the first extension extends from the end of the second arm, the second extension extending from the base of the second arm, and the second arm, the first extension and the second extension form a generally "T"-shaped opening adapted to engage the clip.

In another embodiment, there is a third arm extending at approximately 90 degrees from the base of the "U"-shaped base and forming a first receptacle area with respect to the first arm of the "U"-shaped base and a second receptacle area with respect to the second arm of the "U"-shaped base, the first receptacle is adapted to receive a reveal strip and the second receptacle is adapted to engage the clip.

In another embodiment, the third arm has a knob on the end.

Other objects, features, and advantages of the present invention will become apparent upon reading the following description of the preferred embodiment, when taken in conjunction with the drawings and the claims.

DETAILED DESCRIPTION OF THE INVENTION

Figure 1:
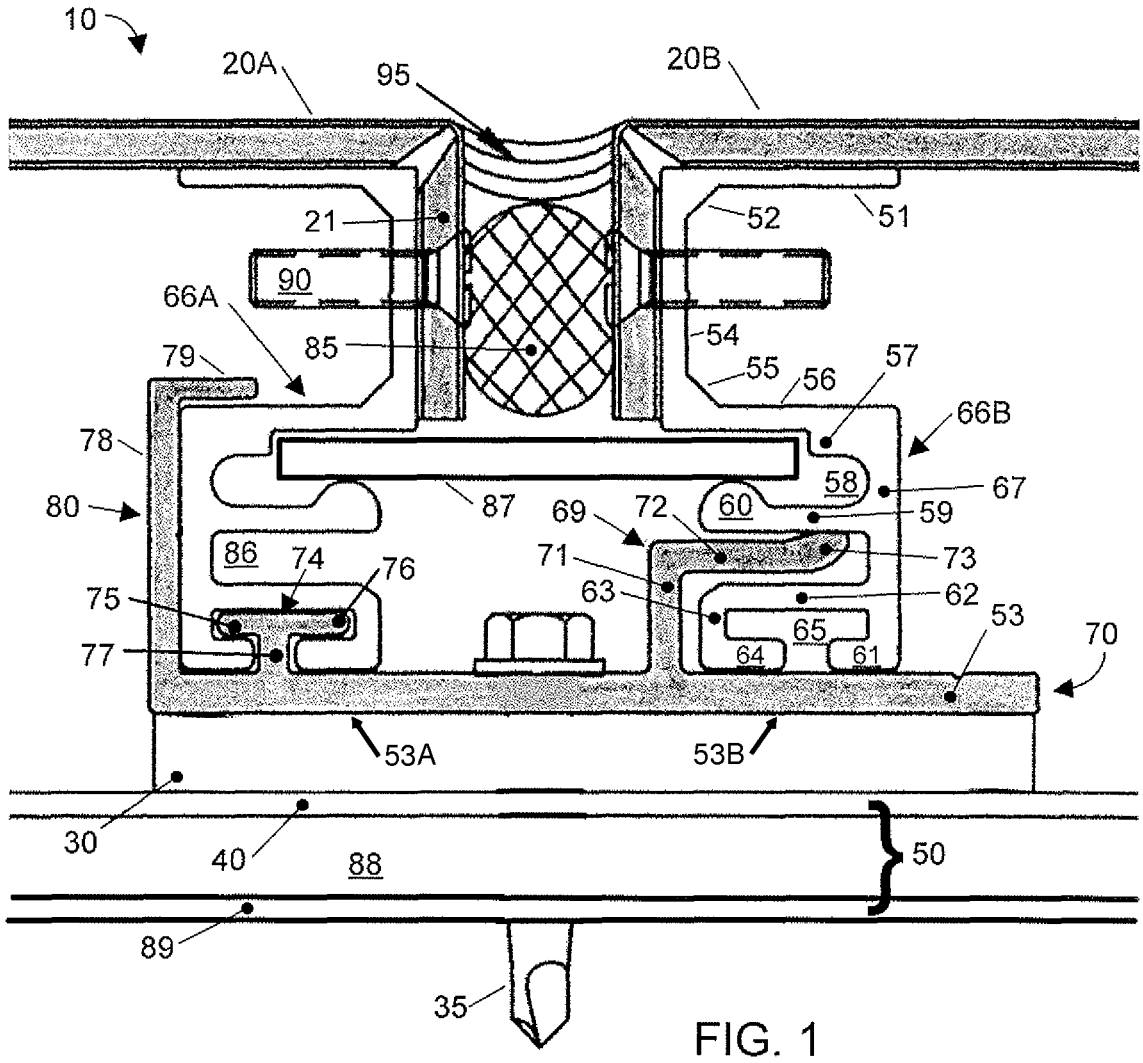
FIG. 1 is an illustration of an exemplary embodiment of the present invention in an exemplary environment.

FIG. 1 is an illustration of an exemplary embodiment of the present invention in an exemplary environment 10. FIG. 1 depicts panels or façades 20A, 20B, each having a respective route and return leg or lip 21, a pair of female mounting extrusions 66A, 66B, panel fasteners 90 for securing the panels 20 to their respective extrusions 66, male attachment clip 70, a plastic shim 30, a vapor barrier 40, a sound proofing and/or insulating barrier material 88, such as gypsum board, a structural substrate 89, and a fastener 35, such as a TEK fastener, for securing the clip 70 to structural substrate 89 though the shim 30 and the barriers 40 and 88. For convenience, barriers 40 and 88, and the structural substrate 89 are collectively sometimes referred to herein as structure 50. It will be appreciated that components 40 and 88 are for wind, rain, water, vibration and/or thermal considerations and are not required simply in order to secure a panel to the structure, but may be required for the considerations above and/or compliance with building codes and regulations. The components 40 and 88 are therefore not required for a exposed sealant system, but are often required and/or used with a dry seal system.

Also shown are an optional reveal strip 87, an optional backing rod 85, and an optional weather strip or sealant 95. These components are used to prevent or minimize the amount of water which may be driven between the panel 20 and the structure 50. Typically, either optional strip 87 will be used, e.g., a "dry seal" system, or optional rod 85 and strip 95 will be used, e.g., a "wet seal" system. If desired, however, components 85, 87 and 95 may all be used so prevent or minimize the amount of such water.

The extrusions 66 and the clip 70 provide for fast, convenient, durable, and reliable attachment of the panel 20 to the surface 89. Although the term "extrusion" is used herein for component 66, it should be appreciated that the term "extrusion" is a common term in the industry for a component which is manufactured by extrusion. Therefore, as the preferred method of manufacture of component 66 is by extrusion, that term, extrusion, is used herein for convenience. It should be understood, however, that the use of the term extrusion is not intended to limit component 66 to manufacture by extrusion. Rather, it is intended that component 66 may be manufactured by any convenient method.

In one embodiment the apparatus includes a clip 70 and first and second extrusions 66. The clip includes a clip base 53 having a first area 53A and a second area 53B, a generally "T"-shaped track 74 extending from the first area, and a generally "L"-shaped stop 69. The clip base has a hole between the "T"-shaped track and the "L"-shaped stop adapted to accommodate a fastener. Consider first the construction of a male clip 70. Components 71, 72 and 73 of the clip 70 form a tensioning stop arm 69. The end 73 of the arm 72 may be a bulb or other protrusion, or may be a bend in the arm 72. This aids in guiding and inserting the arm 69 into the restraining area or pocket 86 of an extrusion 66. Alternatively, the end 73 may be the same as the arm 72, but the arm 72 may be bent at a slight angle to aid in insertion. Components 75, 76 and 77 form a T-channel 74. Optional components 78 and 79 form a secondary reinforcement mechanism 80 for the T-channel 74.

Consider now the construction of the female extrusions 66A, 66B. Components 61, 62, 63 and 64 form a T-slot 65 for engagement with the T-channel 74. The interior wall 56, the reveal strip stop and corner reinforcement 57, the base 67, and the arm 59 form a reveal strip receptacle 58 for accepting and securing an optional reveal strip 87. The arm 59 preferably has a knob or bulb or other protrusion 60 on the end so that the reveal strip 87 is held tightly against the interior wall 56. The stop 57 limits the insertion of the reveal strip 87 into the receptacle 58 that the both ends of the reveal strip 87 are held by the extrusions 66. Reveal strip stop and corner reinforcement 57 functions both as a reveal stop and to provide corner reinforcement. Arm 59, end 60, base 67, and head 62 function to form a stop, restraining area, or pocket 86 for the tensioning stop arm 69 or a retainer bar 103. The interior wall 56, head 62, and base 67 collectively form a U-shaped base.

A panel 20 is secured to an attachment leg 54 of an extrusion 66 by a fastener 90. An optional panel stress relief 51 provides a stress relief for the panel 20 for positive pressure situations, that is, the wind is tending to force the panels 20 into the structure to which they are attached. Components 52 and 55 provide for optional corner reinforcement at the intersections of panel stress relief 51 and attachment leg 54, and attachment leg 54 and interior wall 56, respectively.

Shim 30 and barriers 40 and 88 are as specified by the drawing plans and/or code requirements.

From an inspection of FIG. 1 it will be seen that the male clip 70 is secured to the structural surface 89 by the fastener 35. If there is positive pressure on the panels 20A and 20B, the panels 20A, 20B will exert force on the extrusions 66A, 66B, respectively, by their respective fasteners 90 and/or panel stress reliefs 51. The force from the panels 20A, 20B will be applied to the clip 70 by the T-slot legs 61 and 64 of the respective extrusions 66A, 66B. In the case of panel 20B and extrusion 66B, the force from the panel 20B, to a lesser degree, may also be applied to the tensioning stop arm 69 of the clip 70 by the arm 59. The clip 70 then presses against the shim 30 and the structure 50.

If there is negative pressure on the panels 20A and 20B, that is, the wind is tending to pull or force the panels 20 away from the structure to which they are attached, the panels 20A, 20B will exert the tensioning force on the extrusions 66A, 66B, respectively by their respective fasteners 90. The extrusion 66A then applies the tensioning force to the clip 70 on one end of a panel 20 primarily via the T-channel 74 and T-slot 65, and, to a lesser extent, via the extrusion component interior wall 56 and the secondary reinforcement 78 and 79. At the other end of the panel, another extrusion 66B then applies the tensioning force to another clip 70 via the head 62 and the arm 72 of the other clip 70. The clips 70 then apply the tensioning forces to the structure via the fasteners 35.

It should be noted that use of reinforcing corners 52, 55 and/or 57 is preferred, but is optional. Likewise, use of the panel stress relief 51 is preferred, but is optional. In addition, the use of the secondary reinforcement 80 is preferred, but is optional. In a preferred embodiment, the base 53 of the clip 70 extends to the base 78 of the secondary reinforcement 80 on one side, and extends past the base 71 of the tensioning stop arm 69 on the other side, as shown in FIG. 1. This is not mandatory, however, and the base 53 may be shortened on either or both sides, as desired or required. In addition, the base 53 may extend past the secondary reinforcement 80, or may extend further past the stop arm 69, to provide for more surface area over which to distribute wind loading.

In addition, if a reveal strip 87 will not be used, then the reveal strip stop 57 may be eliminated unless desired for corner reinforcement, the component 60 may be eliminated, and the arm 59 may be eliminated. Thus, in its basic form, a clip 70 may comprise a base 53, a tensioning stop arm 69, and a T-channel 74 Likewise, in its basic form, an extrusion 66 may comprise attachment leg 54, an interior wall 56, and the T-slot 65.

A first panel 20A and a second panel 20B are secured to a structure. Each panel 20A, 20B has a main portion, a lip, and a hole in the lip. In one embodiment the clip 53 has a clip base having a first area 53A and a second area 53B, and there is a generally "T"-shaped track 74 extending from the first area, and a generally "L"-shaped stop 69 having a first base 71 extending from the second area and an arm 72 extending from the distal end of the first base, the arm generally extending parallel to the clip base and away from the first area. The clip base has a hole between the "T"-shaped track and the "L"-shaped stop and is adapted to accommodate a fastener 35 to secure the clip to, for example, the structure.

First 66A and second 66B extrusions are preferably used with the clip. Each extrusion preferably has a generally "U"-shaped base having a first arm 59 and a second arm 62, the second arm having an end 60 and a base, and the "U"-shaped base is adapted to receive the "L"-shaped stop of the clip. There is a first leg 67, 56, 54 extending from the first arm 62 of the "U"-shaped base and having a hole therein to accommodate a fastener 90 to secure the extrusion to a panel, the first extrusion to be secured to, for example, the first panel and the second extrusion to be secured to, for example, the second panel. There are also first 61 and second 64 generally "L"-shaped extensions extending from the second arm 62 of the "U"-shaped base, the first extension 64 extending from the end of the second arm, the second extension 61 extending from the base of the second arm 62. The first extension 64, the second extension 61 and the second arm 62 form a generally "T"-shaped opening adapted to receive the "T"-shaped track 74. In this embodiment the "U"-shaped base of the first extrusion receives the "L"-shaped stop 69 and the "T"-shaped opening of the second extrusion receives the "T"-shaped track 74.

In another embodiment, a panel is secured to a structure having a clip attached thereto, the clip having a clip base and a unitary "T"-shaped protrusion 74 therefrom. There is a base 61, 62, 63, 64, having two "L"-shaped extensions 61, 64 adapted to substantially engage and surround the top of the unitary "T"-shaped protrusion, at least part of one "L"-shaped extension adapted to be engaged between the clip base and the top of the unitary "T"-shaped protrusion. There is also a panel attachment section 67, 56, 54 extending from the base and having a hole therein to accommodate a fastener 90 to secure the apparatus to the panel. In one embodiment a first section 67 of the panel attachment section extends at approximately 90 degrees from the base. In another embodiment a second section 56 extends from, and is substantially perpendicular to, the first section. In still another embodiment, a third section 54 extends from, and is substantially perpendicular to, the second section.

Figure 2:
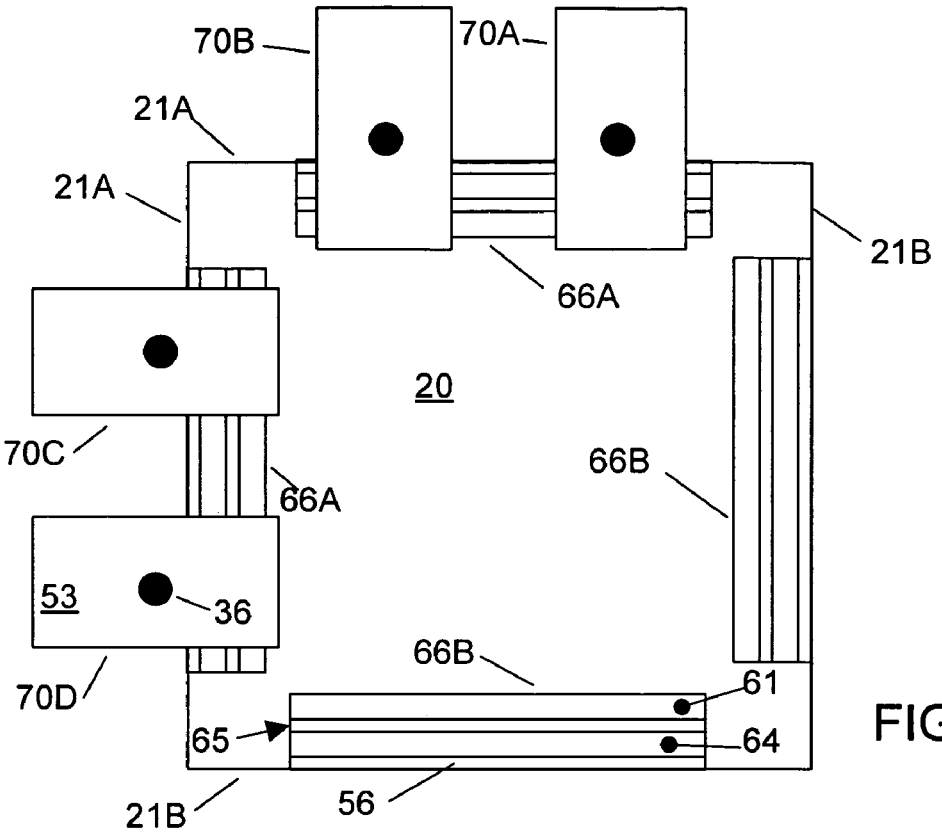
FIG. 2 is a bottom view illustration of a panel 20 with an exemplary embodiment of the present invention.

FIG. 2 is a bottom view illustration of a panel 20 with an exemplary embodiment of the present invention. The view is looking at the inside of the panel; that is, the lips 21 of the panel 20 are pointing toward the reader. There is preferably a lip 21A, 21B on each side of the panel 20. Four extrusions 66 are shown, and the view is looking at the bottom of an extrusion; that is, the reader is looking into the T-slot 65. Shown are the two feet 61, 64 of the T-slot 65, and part of the interior wall 56. Two extrusions 66A have clips 70 attached. One extrusion 66A has clips 70A and 70B attached, and the other extrusion 66A has the clips 70C and 70D attached. The clips 70 have a hole 36 for the fastener 35. Preferably, to save time at the construction site, the panels 20 are shipped to the desired location with the extrusions 66 and clips 70 already attached, as shown.

Figure 3:
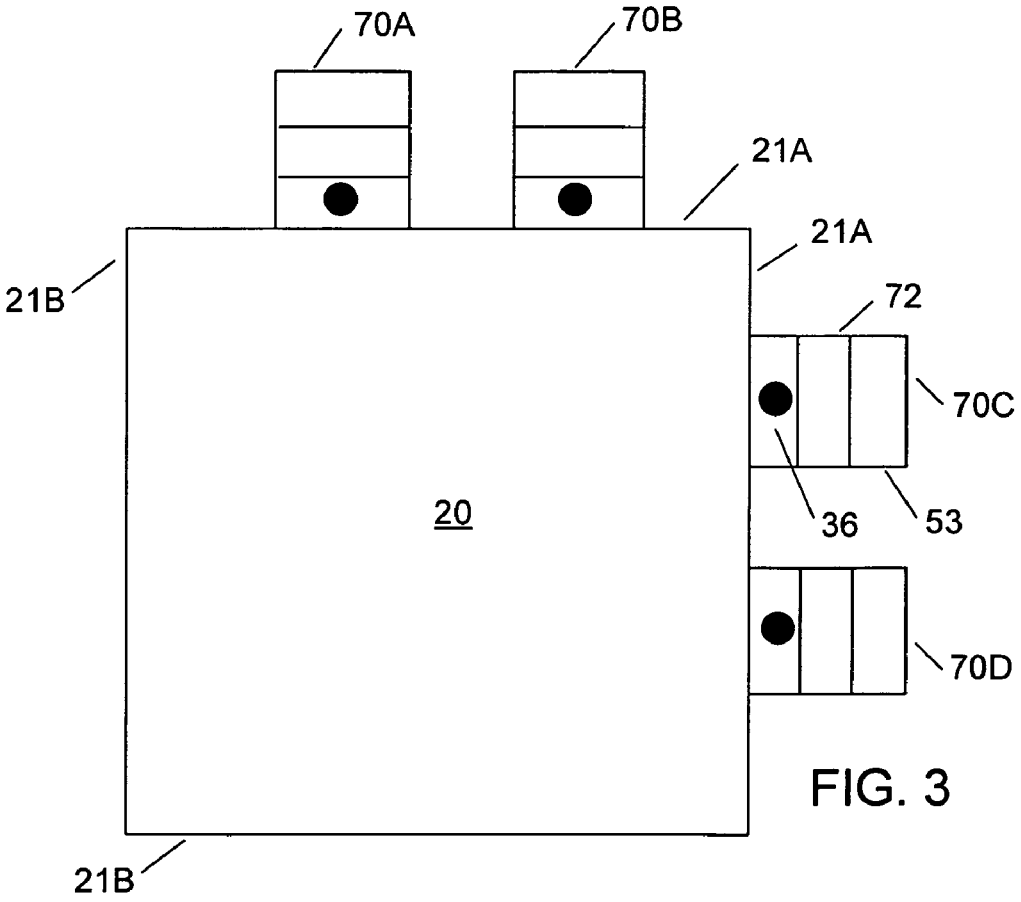
FIG. 3 is a top view illustration of a panel 20 with an exemplary embodiment of the present invention.

FIG. 3 is a top view illustration of a panel 20 with an exemplary embodiment of the present invention. The view is looking at the outside of the panel; that is, the lips 21 of the panel 20 are pointing away from the reader. Part of the clips 70, a portion of the base 53, the arm 72 of the tensioning stop arm 69, and a hole 36 for the fastener 35 are shown.

Figure 4:
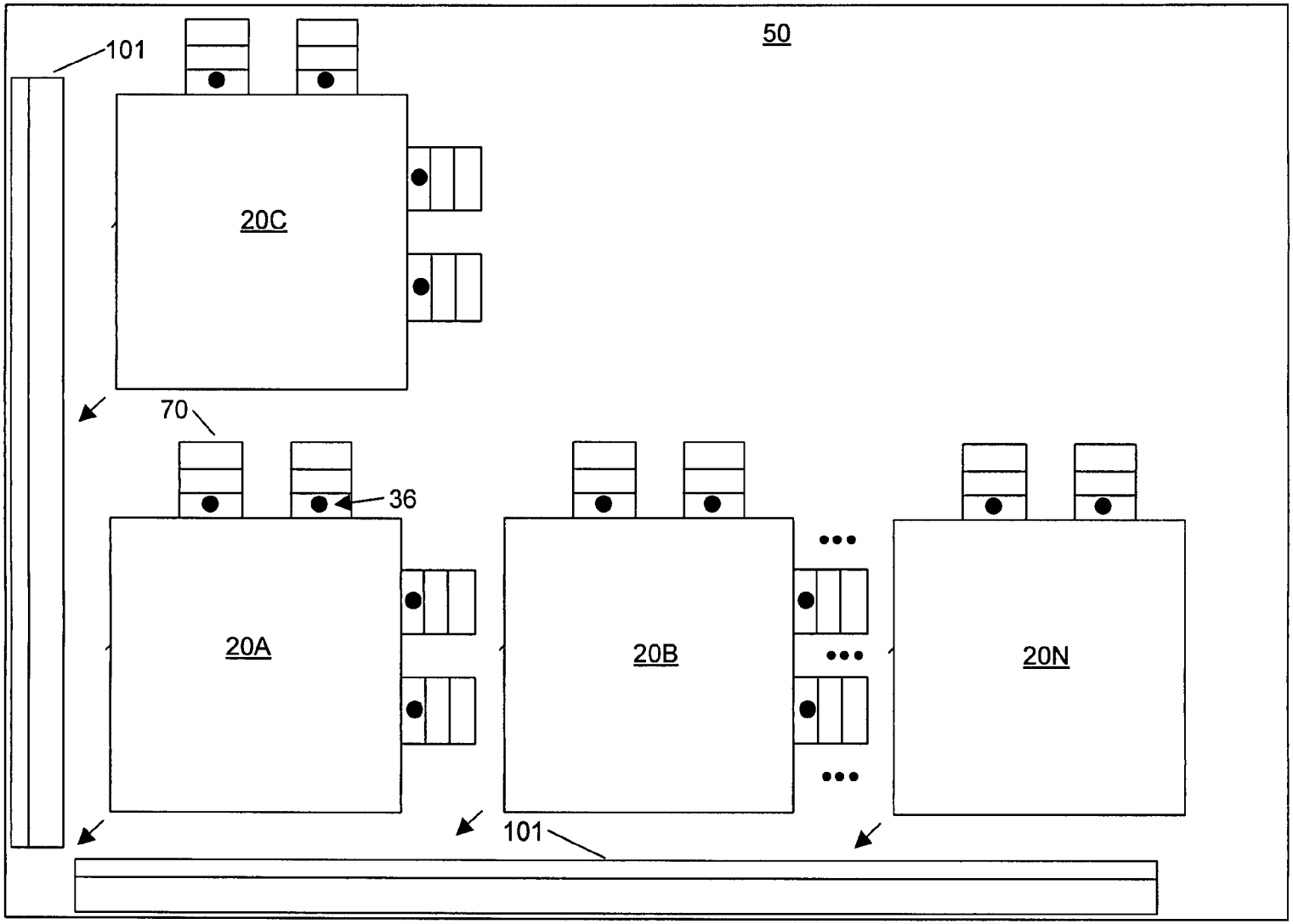
FIG. 4 is an illustration of the installation of panels on an exemplary structure.

FIG. 4 is an illustration of the installation of panels 20 on an exemplary structure 50, such as the side of a building. Two J-connectors 101 are placed on and attached to the structure at two sides, e.g., the bottom side and the left side. In this illustration, the first panel 20A is installed by placing it on or proximate to the structure 50, and then sliding or moving the panel 20A toward the junction of the two J-connectors 101. This causes the J-connectors 101 to engage the extrusions 66B of panel 20A. Once the panel 20A is in place, fasteners 35 are inserted through the holes 36 in the clips 70 and into the structure 50. Unlike a clip 70, which is preferably but not necessarily a short piece, a J-connector 101 is preferably, but not necessarily, a long, continuous piece which spans several panels 20 or even the entire span to which the panels 20 are to be applied. A J-connector is also commonly referred to as a J-channel.

The next panel 20B is installed in a similar manner, but the restraining area 86 of one extrusion 66 of panel 20B will engage the clip 70 associated with panel 20A, and the restraining area 86 of another extrusion 66 of panel 20B will engage the lower J-connector 101. The next panel (not shown) is installed in a similar manner, but the restraining area 86 of one extrusion 66 of this next panel will engage the tensioning stop arm 69 of the clip 70 associated with panel 20B, and the other extrusion 66 of this panel 20 will engage the lower J-connector 101. This action preferably continues until a row of panels 20 has been installed, at which point the last panel 20N in the row is installed.

Figure 6:
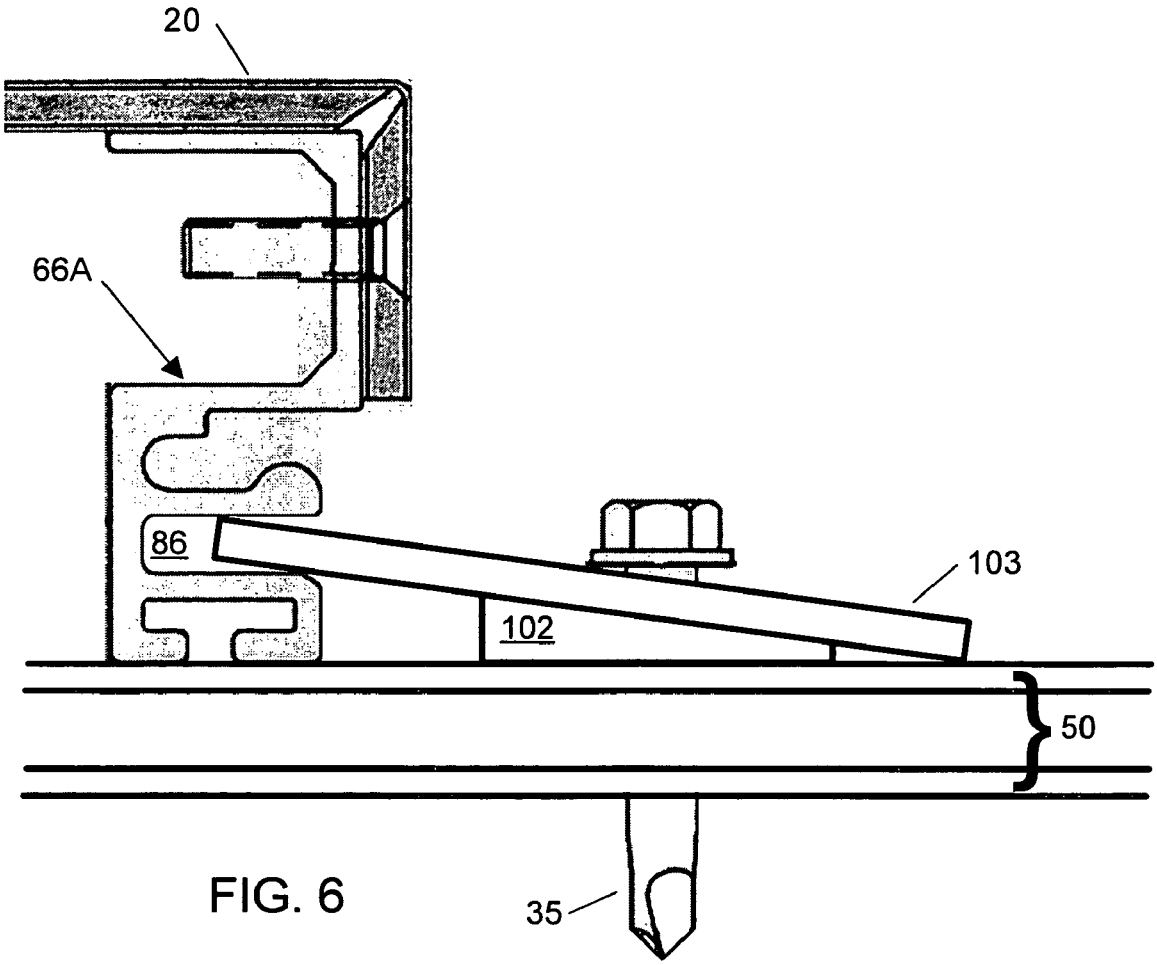
FIG. 6 illustrates an exemplary method of attachment of the last panel of a row to the structure.

At this point, a plurality of options are available for fastening the last panel 20N to the structure 50. In a preferred embodiment, the last panel 20N of a row differs from the other panels 20 in that the right-side extrusions of the last panel 20N does not have clips attached thereto. Therefore, the clips on the top-side extrusions of the last panel 20N are fastened to the structure 50 in the manner described above, but the right-side extrusions are preferably fastened using a retainer bar 103 and, preferably but not necessarily, a plastic spacer or shim 102. FIG. 6 shows a preferred method of attaching an extrusion 66A to the structure 50. A retainer bar 103 is inserted into the restraining area 86 and then fastened to the structure 50 using a fastener 35. It will be noticed that the area 86 is at a different level than the structure 50. Thus, merely inserting the retainer bar 103 into the area 86 and fastening the bar 103 to the structure 50 could deform or damage the bar 103. Therefore, preferably, an optional spacer 102 is used. Although the spacer 102 is shown as having an angled face, e.g., the spacer 102 is a shim, and provides for the bar 103 entering the area 86 at an angle, this is merely a preferred embodiment. In an alternative embodiment the spacer 102 is a flat spacer, e.g., a washer, and is used to raise the bar 103 to approximately the same height as the area 86 so that the bar 103 enters the area 86 at a smaller angle. It is preferred that there be at least some angle so that the bar 103 exerts a force tending to hold the extrusion 66 against the structure 50. If the extrusion 66 is not held somewhat tightly against the structure 50 then there may be a tendency for the panels to vibrate or rattle.

Returning to FIG. 4, in an alternative embodiment, the last panel 20N of a row is the same as the other panels 20 and the clips on the top-side extrusions and the right-side extrusions (not shown) of the last panel 20N are fastened to the structure 50 in the manner described above for the other panels.

Once a row of panels 20 has been installed, the next row is begun. The first panel 20C of this next row is installed in a similar manner, but one extrusion 66 of panel 20C will engage the clip 70 associated with panel 20A, and the other extrusion 66 of panel 20C will engage the J-connector 101 on the left side. The next panel (not shown) in the row is then installed, and so on, until that row is complete, at which point the last panel in the row is fastened to the structure 50, and the first panel in the next row is begun. This process is repeated until the next to the last row has been installed and fastened.

Although, in the preferred embodiment, the first row is installed, and then the second row is installed, etc., the panels may be installed in different manners if desired. For example, a first column of panels may be installed, and then the second column, and so on. As another example, panel 20A may be installed, and the panels may then be installed as diagonals. For example, either panel 20B or panel 20C is installed, and then the other panel 20C or 20B is installed, thus completing the first diagonal. Then a panel is installed above either panel 20C or to the right of panel 20B, thus starting the next diagonal, and so on. One can also start as a row installation, or as a column installations, or as a diagonal installation, and then switch to a different installation method as the work progresses.

For convenience of illustration, only two rows and three columns of panels 20 are shown. However, in a typical environment, there will be multiple rows and columns.

The panels 20 of the top row (not shown) preferably, but not necessarily, differ from the other panels 20 in that the top extrusions of the panels 20 of the last row do not have clips 70 attached thereto. The panels 20 in the top row are therefore also preferably directly fastened to the structure 50 using the bar 103 and optional spacer 102 as described with respect to FIG. 6. In an alternative embodiment, the panels 20 of the top row are the same as the other panels 20 and are fastened to the structure 50 in the same manner as the other panels.

If reveal strips 87 are to be used then, as two panels are mounted side-by-side, or top-to-bottom, a reveal strip is preferably installed between those panels before proceeding with the installation of the next panel. The reveal strips 87 may also be installed, however, on a row or a column once the entire row or column is complete. Further, the reveal strips 87 may also be installed at any time, although installation may become more difficult once the next row or column has been installed and access becomes restricted or limited. The panels 20 may also be shipped with the reveal strips already installed into the extrusions 66A. Reveal strips which are not needed, such as those at the right end of the row or those on the top end of the top row, may then be removed and discarded. Of course, some panels 20 may be shipped with the reveal strip 87 installed and some panels may be shipped without reveal strips 87. Preferably, a reveal strip 87 is cut to size in the field from a long length of reveal strip material.

Figure 5:
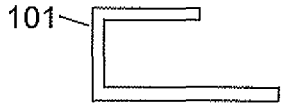
FIG. 5 is a side view of an exemplary J-connector.

FIG. 5 is a side view of an exemplary J-connector 101. J-connectors are well known in the art and different styles or embellishments of J-connectors may be used. A J-connector 101 is designed to interface with an extrusion 66 as described herein. The specific dimensions of the J-connector will depend upon the specific dimensions of the extrusion 66 with which it is intended to work. The design and manufacture of a J-connector which functions with an extrusion 66 will be apparent to one of ordinary skill in the art.

FIG. 6 illustrates an exemplary method of attachment of the last panel 20 of a row to the structure 50. This exemplary method is preferably used to attach the right edges of the rightmost panels, such as 20N, to the structure 50, and to attach the top edges of the panels 20 of the top row to the structure 50.

In an embodiment for use with an exemplary 10 inch by 10 inch panel 20, there will be two clips 70 on a side of the panel, a clip having base 53 dimensions of approximately 3 inches by 3 inches, and the clip having a height (bottom of component 53 to top of component 79) of approximately 1½ inches.

It will be appreciated from an inspection of the figures that a panel is free to move as required. For example, referring to FIG. 4, once installed, although the clips 70 are fastened to the surface, the panel 20 is not. Rather, the panel 20 can move upward or downward because the tensioning stop arm 69 and the T-channel 74 can move up or down within the restraining area 86 and the T-slot 65, respectively. Likewise, the panel 20 can move sideways because the tensioning stop arm 69 and the T-channel 74 can move up or down within the restraining area 86 and the T-slot 65, respectively. Further, as the panel 20 expands or contracts, the tensioning stop arm 69 can move further into or move so as to withdraw from the restraining area 86. However, note that a panel cannot pull away from the structure 50 and fall because the panel is always gripped on at least one side, and preferably at least two sides, by the combination of T-channel 74 and T-slot 65. The combination of T-channel 74 and T-slot 65 may be considered to be a movable locking mechanism because they will slide relative to each other, but are locked to each other in that they will not separate simply by pulling on the panel or sliding the panel slightly in any direction.

Similarly, in an embodiment for use with an exemplary 10 inch by 10 inch panel 20, there will be one extrusion 66 on each side of the panel, and an extrusion will have a length of approximately 6 inches, will have a height (bottom of component 61 to top of component 51) of approximately 1½ inches, and a width (outside of component 54 to outside of component 67) of approximately ¾ inch.

It should be understood that these dimensions and numbers are merely to illustrate one embodiment and are not limited. Depending upon the panel size, the strength of the structure 50, and the weather environment, more or fewer clips 70 may be required, the size of the clips 70 may be larger or smaller, and the size of the extrusions 66 may be larger or smaller. Also, if the panels are rectangular, rather than square, different dimensions and numbers may be appropriate.

The present invention therefore provides an attachment system for securing panels to a structure in a manner which provides for four-way movement of the panel but which prevents the panel from detaching from the structure and falling.

Although the preferred embodiment has been described with respect to use with panels on a structure, the present invention is not so limited. The present invention may be used to attach any desired and appropriate surface treatment to an underlying object. Further, although the preferred environment illustrated herein shows a flat structure, the present invention may also be used with underlying objects which do not have a flat structure, such as, for example, and not by way of limitation, a circular or oval object. In such cases it may be necessary to adjust the angle of the tensioning stop arm and/or the retainer bar to provide for proper engagement with the restraining area.

Although various embodiments of the present invention have been described in detail herein, other variations may occur to those reading this disclosure without departing from the spirit of the present invention. Accordingly, the scope of the present invention is to be limited only by the claims below.

I claim:

1. An apparatus for securing a first panel and a second panel to a structure, each panel having a main portion, a lip, and a hole in the lip, the apparatus comprising:

a clip, comprising:

a clip base having a first area and a second area, a generally "T"-shaped track extending from the first area, a generally "L"-shaped stop having a first base extending from the second area and an arm extending from the distal end of the first base, the arm generally extending parallel to the clip base and away from the first area, and the clip base having a hole between the "T"-shaped track and the "L"-shaped stop and adapted to accommodate a fastener to secure the clip to the structure; and first and second extrusions, each extrusion comprising:

a generally "U"-shaped base having a first arm and a second arm, the second arm having an end and a base, the "U"-shaped base adapted to receive the "L"-shaped stop of the clip, a first leg extending from the first arm of the "U"-shaped base and having a hole therein to accommodate a fastener to secure the extrusion to a panel, the first extrusion to be secured to the first panel and the second extrusion to be secured to the second panel, first and second generally "L"-shaped extensions extending from the second arm of the "U"-shaped base, the first extension extending from the end of the second arm, the second extension extending from the base of the second arm, the first extension, the second extension and the second arm forming a generally "T"-shaped opening adapted to receive the "T"-shaped track; and wherein the "U"-shaped base of the first extrusion receives the "L"-shaped stop and the "T"-shaped opening of the second extrusion receives the "T"-shaped track.

2. The apparatus of claim 1, wherein the clip further comprises a generally "L"-shaped extension having a base and an arm and extending from the clip base, the "T"-shaped track being between the "L"-shaped extension and the hole, the base of the "L"-shaped extension extending at approximately 90 degrees from the clip base, the arm extending at approximately 90 degrees from the distal end of the base of the "L"-shaped extension, the arm generally extending parallel to the clip base and toward the second area.

3. The apparatus of claim 1 wherein at least one extrusion further comprises a third arm extending at approximately 90 degrees from the base of the "U"-shaped base and forming a first receptacle area with respect to the first arm of the "U"-shaped base and a second receptacle area with respect to the second arm of the "U"-shaped base, the first receptacle adapted to receive a reveal strip, the second receptacle adapted to receive the "L"-shaped stop of the clip.

4. The apparatus of claim 3 wherein the third arm has a knob on the end.

5. The apparatus of claim 1 wherein the "L"-shaped stop has a knob on the distal end.

6. The apparatus of claim 1 wherein the first base of the generally "L"-shaped stop of the clip extends from the second area at approximately 90 degrees.

7. The apparatus of claim 1 wherein the arm of the generally "L"-shaped stop of the clip extends from the distal end of the first base at approximately 90 degrees.

8. The apparatus of claim 1 wherein the first leg of the extrusion extends at approximately 90 degrees from the first arm of the "U"-shaped base.

9. The apparatus of claim 1 wherein at least one of the first or second generally "L"-shaped extensions of the extrusion extend at approximately 90 degrees from the second arm of the "U"-shaped base.

10. An apparatus to secure a panel having an extrusion to a structure, the apparatus comprising:

a clip base having a first area and a second area;

a generally "T"-shaped track extending from the first area and adapted to engage the extrusion, the base of the generally "T"-shaped track projecting directly from the first area;

a generally "L"-shaped stop adapted to engage the extrusion, and having a first base extending from the second area at approximately 90 degrees and an arm extending from the distal end of the first base at approximately 90 degrees, the arm generally extending parallel to the clip base and away from the first area;

the clip base having a hole between the "T"-shaped track and the "L"-shaped stop and adapted to accommodate a fastener to secure the clip to a structure; and a generally "L"-shaped extension having a base and an arm and extending from the clip base, the "T"-shaped track being between the "L"-shaped extension and the hole, the base of the "L"-shaped extension extending at approximately 90 degrees from the clip base, the arm extending at approximately 90 degrees from the distal end of the base of the "L"-shaped extension, the arm generally extending parallel to the clip base and toward the second area.

11. The apparatus of claim 10 wherein the "L"-shaped stop has a knob on the distal end.

12. The apparatus of claim 10 wherein the first base of the generally "L"-shaped stop extends from the second area at approximately 90 degrees.

13. The apparatus of claim 10 wherein the arm extends from the distal end of the first base at approximately 90 degrees.

14. An apparatus to secure a panel to a structure having a clip attached thereto, the apparatus comprising:

a generally "U"-shaped base having a first arm and a second arm, the second arm having an end and a base, the "U"-shaped base adapted to engage the clip;

a first leg extending from the first arm of the "U"-shaped base and having a hole therein to accommodate a fastener to secure the apparatus to the panel; and first and second generally "L"-shaped extensions extending from the second arm of the "U"-shaped base, the first extension extending from the end of the second arm, the second extension extending from the base of the second arm, the first extension, the second extension and the second arm forming a generally "T"-shaped opening adapted to engage the clip.

15. The apparatus of claim 14 and further comprising a third arm extending at approximately 90 degrees from the base of the "U"-shaped base and forming a first receptacle area with respect to the first arm of the "U"-shaped base and a second receptacle area with respect to the second arm of the "U"-shaped base, the first receptacle adapted to receive a reveal strip, the second receptacle adapted to engage the clip.

16. The apparatus of claim 15 wherein the third arm has a knob on the end.

17. The apparatus of claim 14 wherein the first leg extends at approximately 90 degrees from the first arm of the "U"-shaped base.

18. The apparatus of claim 14 wherein at least one of the first or second generally "L"-shaped extensions extends at approximately 90 degrees from the second arm of the "U"-shaped base.

19. A surface treatment for an underlying object, comprising:

a first panel and a second panel, each panel having a main portion, a lip, and a hole in the lip;

a clip, comprising:

a clip base having a first area and a second area, a generally "T"-shaped track extending from the first area, a generally "L"-shaped stop having a first base extending from the second area and an arm extending from the distal end of the first base, the arm generally extending parallel to the clip base and away from the first area, and the clip base having a hole between the "T"-shaped track and the "L"-shaped stop and adapted to accommodate a fastener to secure the clip to the underlying object; and first and second extrusions, each extrusion comprising:

a generally "U"-shaped base having a first arm and a second arm, the second arm having an end and a base, the "U"-shaped base adapted to receive the "L"-shaped stop of the clip, a first leg extending from the first arm of the "U"-shaped base and having a hole therein to accommodate a fastener to secure the extrusion to a panel, the first extrusion to be secured to the first panel and the second extrusion to be secured to the second panel, and first and second generally "L"-shaped extensions extending from the second arm of the "U"-shaped base, the first extension extending from the end of the second arm, the second extension extending from the base of the second arm, the second arm, the first extension and the second extension forming a generally "T"-shaped opening adapted to receive the "T"-shaped track;

wherein the "U"-shaped base of the first extrusion receives the "L"-shaped stop and the "T"-shaped opening of the second extrusion receives the "T"-shaped track.

20. An apparatus to secure a panel to a structure having a clip attached thereto, the clip having a clip base and a unitary "T"-shaped protrusion projecting directly therefrom, the apparatus comprising:

a base, having two "L"-shaped extensions adapted to substantially engage and surround the top of the unitary "T"-shaped protrusion, at least part of one "L"-shaped extension adapted to be engaged between the clip base and the top of the unitary "T"-shaped protrusion; and a panel attachment section extending from the base and having a hole therein to accommodate a fastener to secure the apparatus to the panel.

21. The apparatus of claim 20 wherein the panel attachment section comprises a first section extending from the base.

22. The apparatus of claim 21 wherein the first section of the panel attachment section extends at approximately 90 degrees from the base.

23. The apparatus of claim 22 wherein the panel attachment section further comprises a second section extending from, and substantially perpendicular to, the first section.

24. The apparatus of claim 23 wherein the panel attachment section further comprises a third section extending from, and substantially perpendicular to, the second section.

25. The apparatus of claim 24 wherein the third section has the hole to accommodate the fastener.

* * * * *